US009624726B2

(12) United States Patent
Hurtado

(10) Patent No.: US 9,624,726 B2
(45) Date of Patent: Apr. 18, 2017

(54) SYSTEM AND METHODOLOGY FOR MECHANICALLY RELEASING A RUNNING STRING

(71) Applicant: Schlumberger Technology Corporation, Sugar Land, TX (US)

(72) Inventor: José F. Hurtado, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 667 days.

(21) Appl. No.: 13/967,749

(22) Filed: Aug. 15, 2013

(65) Prior Publication Data

US 2015/0047853 A1 Feb. 19, 2015

(51) Int. Cl.

| | |
|---|---|
| ***E21B 7/06*** | (2006.01) |
| ***E21B 23/12*** | (2006.01) |
| *E21B 23/00* | (2006.01) |

(52) U.S. Cl.

CPC ..... *E21B 7/061* (2013.01); *E21B 23/002* (2013.01); *E21B 2023/008* (2013.01)

(58) Field of Classification Search

None

See application file for complete search history.

(56) References Cited

U.S. PATENT DOCUMENTS

| | | | | |
|---|---|---|---|---|
| 5,944,108 | A | 8/1999 | Baugh et al. | |
| 6,209,648 | B1 | 4/2001 | Ohmer et al. | |
| 2002/0000319 | A1 | 1/2002 | Brunet | |
| 2002/0074121 | A1 | 6/2002 | Schick et al. | |
| 2004/0011529 | A1* | 1/2004 | McGarian | E21B 41/0042 166/313 |
| 2004/0016547 | A1 | 1/2004 | Brunet et al. | |
| 2004/0159429 | A1 | 8/2004 | Brockman et al. | |
| 2009/0101345 | A1* | 4/2009 | Moffitt | E21B 7/20 166/285 |
| 2010/0059279 | A1* | 3/2010 | Saylor | E21B 41/0035 175/40 |
| 2012/0175132 | A1* | 7/2012 | Watson | E21B 33/04 166/386 |
| 2012/0205091 | A1* | 8/2012 | Turley | E21B 33/1216 166/77.53 |

FOREIGN PATENT DOCUMENTS

| | | |
|---|---|---|
| WO | WO2011159890 | 12/2011 |

OTHER PUBLICATIONS

International Search Report and Written Opinion issued in PCT/US2014/050488 on Nov. 21, 2014, 10 pages.

* cited by examiner

*Primary Examiner* — Jennifer H Gay
*Assistant Examiner* — Caroline Butcher
(74) *Attorney, Agent, or Firm* — Jeffery R. Peterson

(57) ABSTRACT

A technique facilitates selectively disengaging a running string from a lateral tube assembly. The running string comprises a running sub which is engageable with the lateral tube assembly. The running string further comprises a window finder which is positioned to extend into a main bore casing window when the running string is deployed downhole with the lateral tube assembly. Additionally, the running string comprises an extension sub which is coupled to the window finder. The extension sub is selectively extensible to disengage the window finder from the main bore casing prior to release of the running sub from the lateral tube assembly via a release force applied through the running string.

21 Claims, 9 Drawing Sheets

SYSTEM AND METHODOLOGY FOR MECHANICALLY RELEASING A RUNNING STRING

BACKGROUND

The use of multilateral wells has become common in facilitating the production of desired fluids, e.g. oil and gas. A main wellbore is drilled and then lined with a casing which is cemented in the main wellbore. Subsequently, an opening or window is formed through the casing to enable drilling of a lateral wellbore. A lateral tubing, sometimes referred to as a liner, is then moved downhole through the main wellbore casing and out through the window into the lateral wellbore. The lateral tubing is moved downhole by a running tool and coupled with the main wellbore casing by a lateral tube assembly. After placement of the lateral tubing and the lateral tube assembly, the running tool is removed from the wellbore. Depending on the application, additional lateral wellbores may be drilled and lined with lateral tubes, e.g. liners.

SUMMARY

In general, a methodology and system are provided for selectively disengaging a running string from a lateral tube assembly. The running string comprises a running sub which is engageable with the lateral tube assembly. The running string further comprises a window finder which is positioned to extend into a main bore casing window when the running string is deployed downhole with the lateral tube assembly. Additionally, the running string comprises an extension sub which is coupled to the window finder. The extension sub is selectively extensible to disengage the window finder from the main bore casing prior to mechanical release of the running sub from the lateral tube assembly via a release force applied through the running string.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate the construction of wells having at least one lateral well section. After casing a main wellbore, a main casing window is formed, e.g. milled, and a lateral wellbore is drilled. A lateral tube is deployed into the lateral wellbore via a lateral tube assembly run downhole through the main wellbore casing via a running string. In some applications, multiple lateral wellbores may be drilled from the main wellbore and lined with lateral tubing.

According to an embodiment of the disclosure, a system and methodology are designed to facilitate selective disengagement of a running string. The running string is disengaged from a lateral tube assembly placed into a lateral wellbore with a lateral tubular structure, e.g. liner or sand screen, which extends along the lateral wellbore. The running string comprises a running sub which is releasably engageable with the lateral tube assembly. For example, the running sub may be hydraulically releasable with a redundant or backup mechanical release mechanism.

The running string further comprises a window finder which is oriented to extend into a main bore casing window when the running string is deployed downhole with the lateral tube assembly. Additionally, the running string comprises an extension sub which is coupled to the window finder. The extension sub is selectively extensible to disengage the window finder from the main bore casing prior to mechanical release of the running sub from the lateral tube assembly. By disengaging the window finder from the main bore casing and locking the extension sub in an extended position, a release force may be applied through the running string to cause a mechanically actuated disengagement of the running sub from the lateral tube assembly. In many applications, the system and methodology for disengaging are employed in well environments but the system and methodology can be used in a variety of other environments in which an internal running string is disengaged from a surrounding tube assembly.

Figure 1:
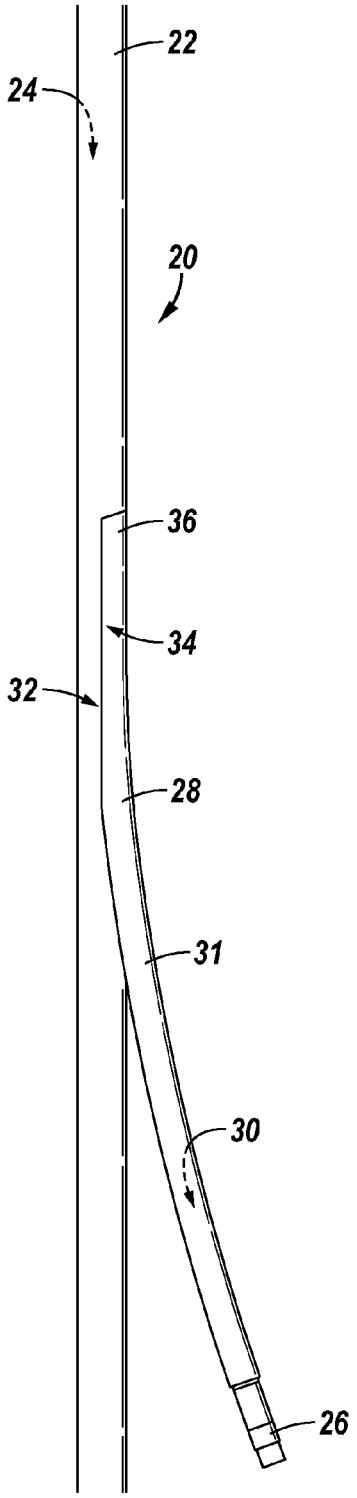
FIG. 1 is an illustration of an example of a well system having a main bore casing deployed in a main wellbore joined by a lateral tube assembly extending into a lateral wellbore, according to an embodiment of the disclosure.

Referring generally to FIG. 1, an embodiment of a well system 20 is illustrated as comprising a main bore casing 22 deployed in a main wellbore 24. The well system 20 further comprises a lateral tubular structure 26, e.g. a lateral liner or sand screen, coupled with a lateral tube assembly 28 and deployed in a lateral wellbore 30. The lateral tube assembly 28 has a lateral tube 31 with a lateral tube window 32 which is aligned and oriented with a main window 34 of the main bore casing 22. Once the lateral tube window 32 and the main window 34 are properly oriented and aligned, the lateral tube assembly 28 may be joined, e.g. affixed, to the main bore casing 22 by, for example, a lateral locating insert 36 of the lateral tube assembly 28. A variety of lateral locating inserts 36 are available and are generally designed to expand radially and to grab the inside of the main bore casing 22 with engagement teeth or other suitable fastening mechanisms. However, the well system 20 is not limited to use with lateral locating inserts 36 and may employ liner hangers or other devices as part of the lateral tube assembly 28.

Figure 2:
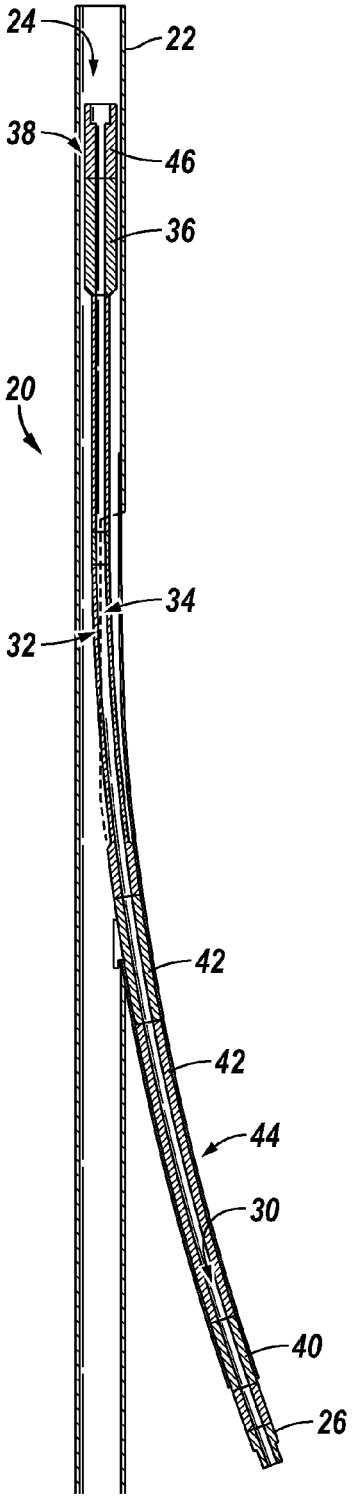
FIG. 2 is an illustration similar to that of FIG. 1 but showing the main bore casing and the lateral tube assembly in cross-section with a running string engaged internally with the lateral tube assembly, according to an embodiment of the disclosure.

As illustrated in FIG. 2, the lateral tube assembly 28 may be deployed down through main bore casing 22 and out through main window 34 via a running string 38. The running string 38 is releasably engaged with the lateral tube assembly 28 along the interior of the lateral tube assembly 28. In the example illustrated, the running string 38 comprises a running sub 40 by which the running string 38 releasably engages the lateral tube assembly 28 along an interior of the lateral tube assembly. In this example, the running string 38 further comprises a window finder 42 and an extension sub 44 coupled to the window finder 42. The running string 38 also comprises an adapter sub 46 which joins a suitable deployment tubing extending up through an interior of main bore casing 22. The deployment tubing extends to the surface and also may be used to supply pressurized fluid from a surface rig pump for shearing and other actions downhole. By running the deployment tubing/adapter sub 46 down through main bore casing 22, the running sub 40 moves lateral tubular structure 26 and lateral tube assembly 28 into the desired position within lateral wellbore 30.

Figure 3:
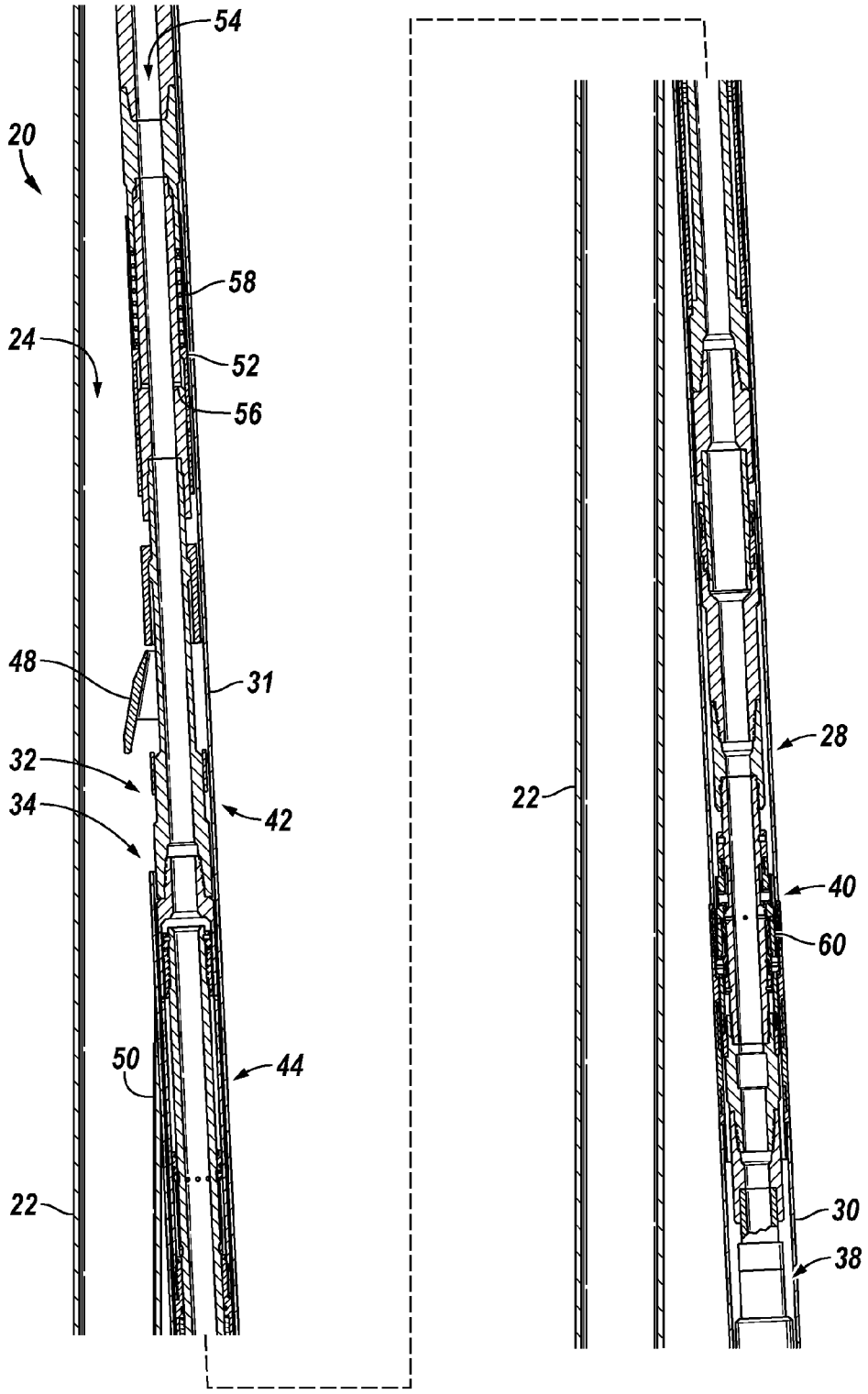
FIG. 3 is an enlarged cross-sectional view of an example of the well system having the main bore casing engaged and aligned with the lateral tube assembly within which a running string is engaged with an interior of the lateral tube assembly, according to an embodiment of the disclosure.

As further illustrated in FIG. 3, the window finder 42 is used to orient and align the lateral tube window 32 with the main window 34 as running string 38 moves lateral tube assembly 28 into proper position extending into lateral wellbore 30. The window finder 42 comprises an engagement feature 48, e.g. a hook mechanism, which is used to engage a casing wall portion 50 of main bore casing 22. Engagement feature 48 may be in the form of a hook mechanism having a variety of shapes and configurations, e.g. fingers, protrusions, and other suitable configurations. In the illustrated example, engagement feature 48 is designed to extend into main window 34 of main bore casing 22 as the lateral tube assembly 28 is moved into place. As the running string 38 moves the lateral tube assembly 28 farther into lateral wellbore 30, the engagement feature 48 is guided by the edge of the main window 34 to properly orient the lateral tube window 32 with respect to the main window 34. Movement of the window finder 42 and running string 38 is stopped when engagement feature 48 abuts against a casing wall portion 50 at the downhole end of the main casing window 34. In the example illustrated, engagement feature 48 comprises a hook which stops against the casing wall portion 50 but engagement feature 48 may have a variety of geometries and sizes.

A variety of techniques may be used to find main casing window 34 with engagement feature 48. For example, the running string 38 may be advanced without rotation. In this embodiment, the running string 38 is moved so that engagement feature 48 is just above a top end of the casing window 34 and pressure is applied to cause radial extension of engagement feature 48 until the engagement feature 48 contacts the internal surface of main bore casing 22. The running string 38 is then advanced without rotation. If engagement feature 48 enters casing window 34 it will orient the lateral tube assembly 28 as it advances. Eventually, the engagement feature 48 catches the casing wall portion 50 which stops further advancement as indicated at the surface rig by a drop in weight. However, if the engagement feature 48 does not enter casing window 34 it will not orient or engage casing wall portion 50. Without engagement, the running string 38 continues to advance and misses the casing window 34 with no weight loss. If no weight loss occurs, the rig operator understands that the casing window 34 was missed and subsequently pulls up the running string 38 while retracting engagement feature 48. An indexing or rotation of the running string 38 is then performed and the running string 38 is again advanced downhole. Once properly oriented, the engagement feature 48 enters the casing window 34 and engages casing wall portion 50. In another embodiment, the running string 38 can be advanced with rotation. In this example, the running string 38 is rotated slowly as it advances to force engagement feature 48 to pop or snap into the casing window 34. When engagement feature 48 enters the casing window 34, the rig operator is able to see an increase in the torque required for rotation which confirms engagement feature 48 has entered the casing window 34. At this stage, the running string 38 can be advanced until engagement feature 48 engages casing wall portion 50.

The engagement feature 48 and the overall window finder 42 may have a variety of configurations and may be actuated via several types of mechanisms. In the embodiment illustrated in FIG. 3, for example, the engagement feature 48 comprises a hook mechanism which may be transitioned between a radially retracted position and a radially extended position. In this example, the engagement feature/hook 48 may be selectively transitioned to a radially extended position in which the hook extends through main casing window 34 for engaging casing wall portion 50. As illustrated, the hook 48 is coupled with a window finder piston 52 which may be linearly translated within lateral tube assembly 28 via pressurized fluid delivered along an interior 54 of running string 38. The pressurized fluid is directed through corresponding pressure passages/ports 56 and against piston 52 so as to cause linear translation of piston 52 which, in turn, forces the radially outward extension of hook 48. In some applications, the engagement feature 48 may be spring biased toward a radially retracted position via a suitable spring 58, such as a coil spring. It should be noted that interior 54 may be designed with a diameter sufficiently large to accommodate passage/pumping of cement and a cementing dart.

After the lateral tube assembly 28 is positioned in lateral wellbore 30; oriented and aligned with the main casing window 34 via window finder 42; and secured to the main bore casing 22 via lateral locating insert 36 (or another suitable device, e.g. liner hanger), the running string 38 may be released from lateral tube assembly 28 for removal. In some applications, a hydraulic release 60 may be employed to hydraulically release running sub 40 from lateral tube assembly 28 via fluid routed through interior 54 of running string 38 and pressurized to a predetermined release level. However, if the hydraulic release 60 does not function properly or if the running string 28 does not utilize a hydraulic release, the running string may be mechanically released by applying an appropriate level of force, e.g. a set down force, along the running string 28. To facilitate application of this force along running string 28, the engagement feature 48 is released from its engagement with the casing wall portion 50 via extension sub 44.

Figure 4:
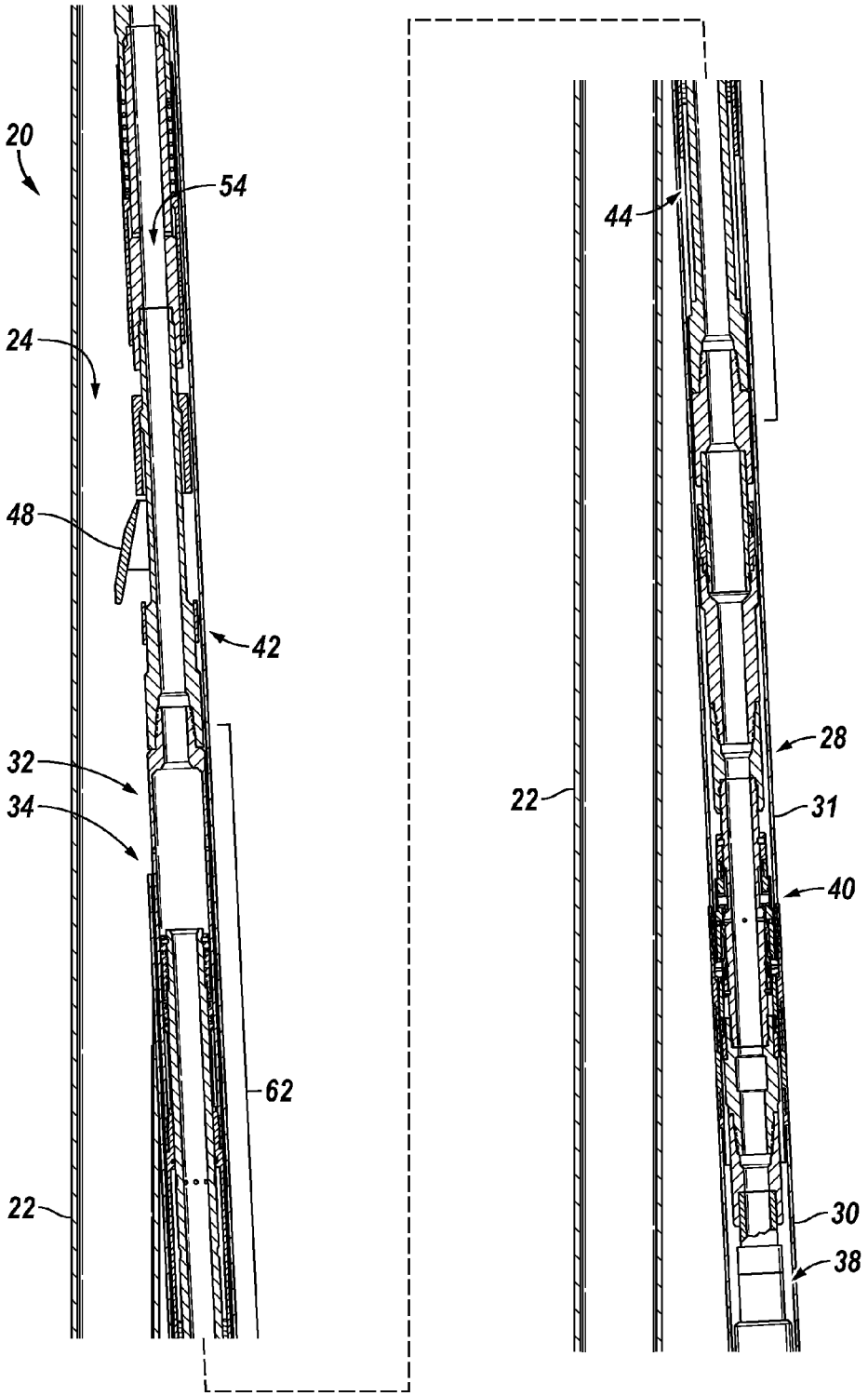
FIG. 4 is an illustration similar to that of FIG. 3 but showing an extension sub of the running string in an extended position, according to an embodiment of the disclosure.

As illustrated in FIG. 4, the extension sub 44 is extensible and may be selectively extended to an extended length 62 which moves the engagement feature 48 away from casing wall portion 50. Once in the extended position, a locking mechanism of the extension sub 44 is utilized to lock the extension sub in this extended position, as discussed in greater detail below. After the extension sub 44 is placed in the extended, locked position, force may be applied along the running string 38 to generate an axial, compressive force or load path along the running string 38 without incurring resistance from engagement feature 48 contacting casing wall portion 50. In some applications, the engagement feature/hook 48 may be retracted radially inwardly once disengaged from casing wall portion 50. The load path of the axial compression may be used for shearing and/or other actions downhole.

Figure 5:
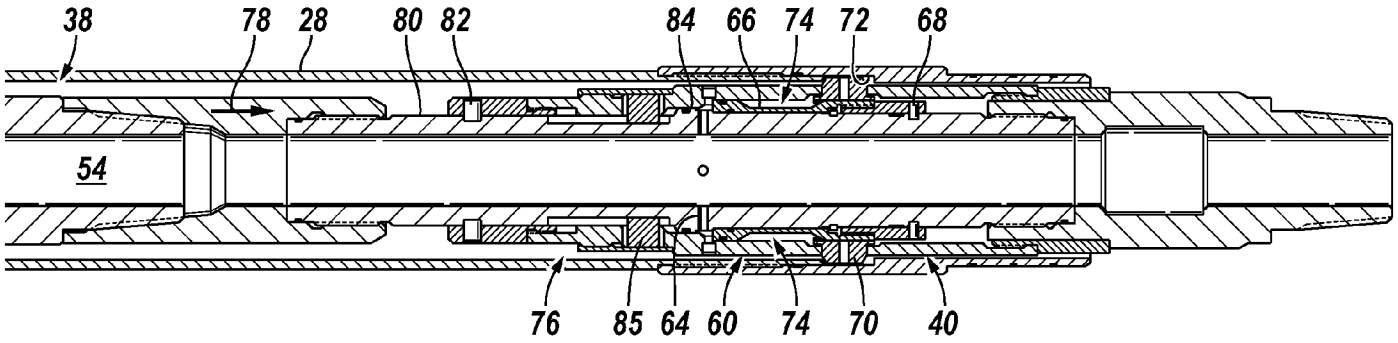
FIG. 5 is a cross-sectional view of an example of a portion of the running string having a running sub engaged with the lateral tube assembly, according to an embodiment of the disclosure.

Referring generally to FIG. 5, an enlarged illustration of the running sub 40 is illustrated as engaged with lateral tube assembly 28 along an interior of the lateral tube assembly 28. In this embodiment, running sub 40 comprises hydraulic release 60 which utilizes a passage 64, e.g. a plurality of pressure ports, which provides a pressure communication path between the interior 54 of running string 38 and a piston 66. Movement of piston 66 may initially be resisted by a shear member 68, such as a plurality of shear pins. However, when sufficient pressure is applied through interior 54 and ports 64, piston 66 is shifted to a position which releases a plurality of dogs 70.

As illustrated, dogs 70 are held in a radially outward position for engagement with corresponding receptacles 72 formed in lateral tube assembly 28. In this manner, the running string 38 is securely engaged with the lateral tube assembly 28 while the lateral tube assembly 28 is run downhole and moved into position in lateral wellbore 30. When hydraulic release 60 is actuated, the shear member 68 is sheared and piston 66 is shifted linearly until the dogs 70 fall radially inwardly into piston recesses 74. In some applications, the dogs 70 may be spring biased or otherwise biased in a radially inward direction to ensure movement into piston recesses 74. Once the dogs 70 are retracted radially into piston recesses 74, the running sub 40 and the overall running string 38 can be moved linearly relative to lateral tube assembly 28. Consequently, the running string 28 may be retrieved to the surface.

If, however, the hydraulic release 60 is inoperable or otherwise unavailable, the running sub 40 comprises a mechanical release 76 which enables the mechanical release of the running sub 40 from lateral tube assembly 28. To mechanically release the running sub 40, the extension sub 44 is first actuated to its extended position (see FIG. 4) to move the engagement feature 48 away from the casing wall portion 50. After separating the engagement feature 48 from the casing, a linear force, e.g. a set down force, may be applied through the running string 38 as indicated by arrow 78. The linear force 78 is directed through a mandrel 80 to shear a shear member 82, such as a plurality of shear pins. Once the shear member 82 is sheared, an abutment member 84 of the mandrel 80 is moved along alignment member 85 and against piston 66. Continued linear movement of mandrel 80 causes piston 66 to translate linearly until dogs 70 are able to move radially inward into piston recesses 74. At this stage, the running sub 40 is released from lateral tube assembly 28 and the running string 38 may be pulled free of the lateral tube assembly 28.

Figure 6:
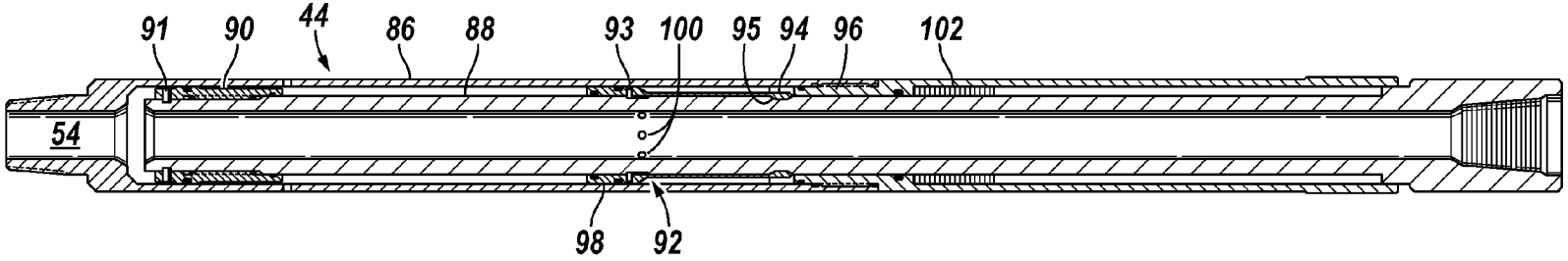
FIG. 6 is a cross-sectional view of an example of an extension sub of the running string, according to an embodiment of the disclosure.

Referring generally to FIG. 6, an enlarged illustration of the extension sub 44 is illustrated. In this embodiment, extension sub 44 comprises a first component 86 slidably engaged with a second component 88. For example, the second component 88 may be in the form of a mandrel telescopically received by first component 86 in the form of a surrounding housing. In FIG. 6, the extension sub 44 is illustrated in a linearly contracted configuration but the extension sub 44 may be elongated or extended to an extended position as illustrated in FIG. 4. The extension may be performed by applying a lifting force which causes separation of the first component 86 relative to the second component 88 in a linear direction.

In the example illustrated, the first component 86 and the second component 88 are extensible upon application of sufficient tensile loading to enable telescopic extension of the first component 86 with respect to the second component 88. A shoulder 90 may be secured to second component 88 by, for example, a fastener 91 and serves to limit extension of sub 44 while also sealing to hold pressure. A torque collet 92 is secured to second component 88 by a shear member 93, e.g. shear pins, and by collet fingertips 94 received in corresponding pockets 95 of second component 88 and in features, e.g. castellations, of a member 96. Member 96 may be an annular member threadably engaged or otherwise coupled to first component 86. The torque collet 92 blocks undesired relative rotation between first component 86 and second component 88 prior to the desired extension and locking of extension sub 44 in the extended configuration. In the example illustrated, torque collet 92 is sealed between an interior surface of the first component 86 and an exterior surface of second component 88 to facilitate pressure release of the collet. For example, fluid may be directed through interior passage 54 of running string 38 and against a piston portion 98 of torque collet 92 via at least one pressure port or passage 100. Application of sufficient pressure causes linear movement and release of torque collet 92 so as to enable relative rotation between the first component 86 and the second component 88. The torque collet 92 prevents relative rotation between first component 86 and second component 88 until shear member 93 is sheared and collet 92 is moved out of the way via pressure. The torque collet 92 moves until stopping against shoulder 90. This allows the extension sub 44 to expand over the extended length 62 until trapped fluid between components 86, 88 causes hydraulic locking which prevents further extension. The system may be designed so that hydraulic locking occurs before member 96 forces collet 92 against shoulder 90.

In some applications, extension sub 44 is designed to allow a minimal relative axial compression between the first component 86 and the second component 88. In this latter embodiment, a spring member 102, e.g. a Belleville spring stack, may be used to bias the first component 86 and the second component 88 against this axial compression. As described in greater detail below, the ability to slightly axially compress the extension sub 44 enables use of a set down force to shear and release the engagement feature 48 of window finder 42. It should be noted that the various linear forces and actuation pressures utilized to create shears and/or releases of certain components can be of varied and predetermined levels to enable desired sequences of actuation. Predetermined sequences of actuation may vary depending on the specifics of a given running string 38 and/or on the parameters of a given deployment and release operation.

Figure 7:
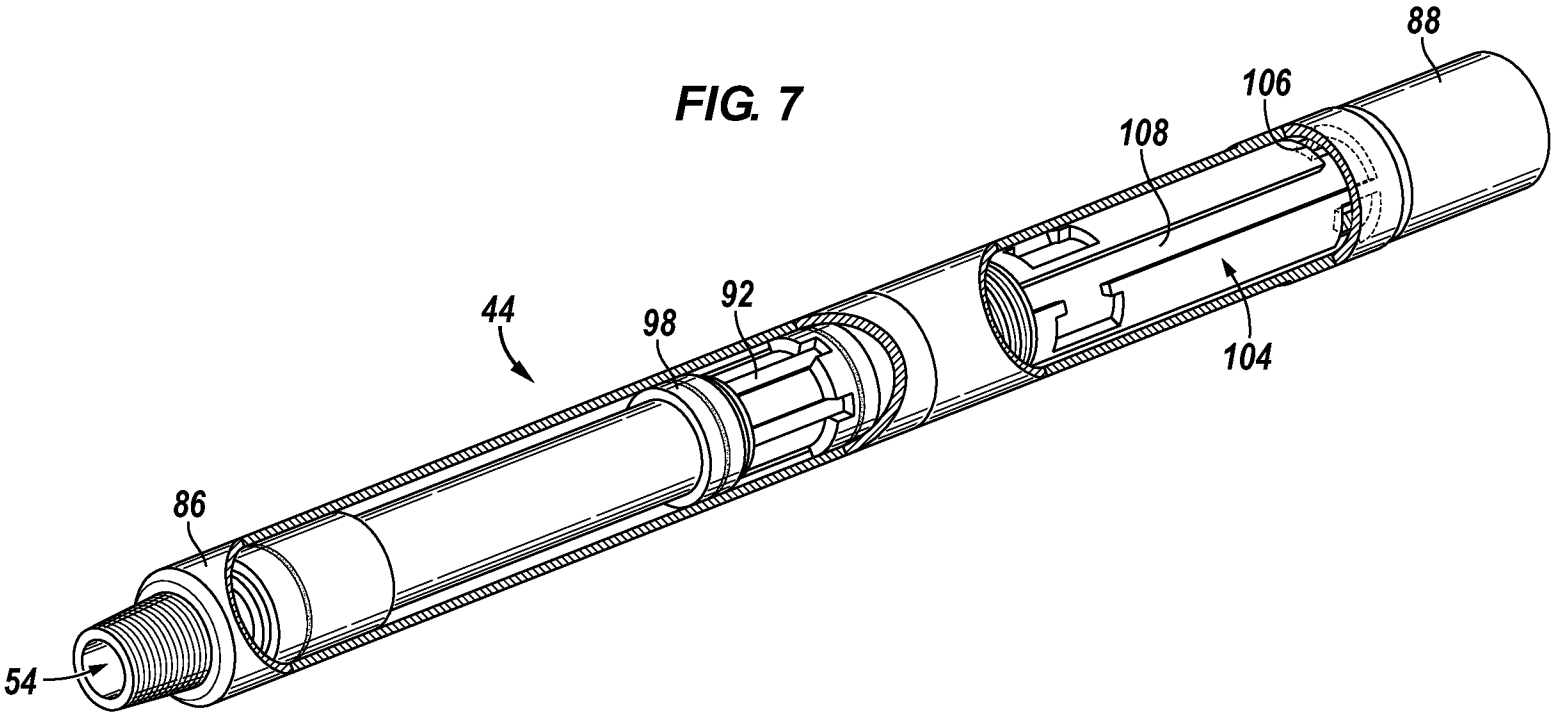
FIG. 7 is an illustration of an example of the extension sub in an initial stage of operation, according to an embodiment of the disclosure.

Extension sub 44 also may comprise a locking mechanism 104 which enables locking of the extension sub in the extended and/or contracted configuration, as illustrated in FIGS. 7-10. Referring generally to FIG. 7, an embodiment of locking mechanism 104 may utilize a member or members 106, e.g. cams, located on one of the first component 86 or second component 88 captured by a corresponding track or tracks 108 located on the other of the first component 86 or second component 88. In the illustrated embodiment, for example, members 106 are mounted in annular member 96 of first component 86 and extend into corresponding tracks 108 formed in second component 88. In the configuration example illustrated in FIG. 7, the members 106 are captured in a generally circumferential extension of the corresponding tracks 108 to lock the extension sub 44 in the contracted configuration.

Figure 8:
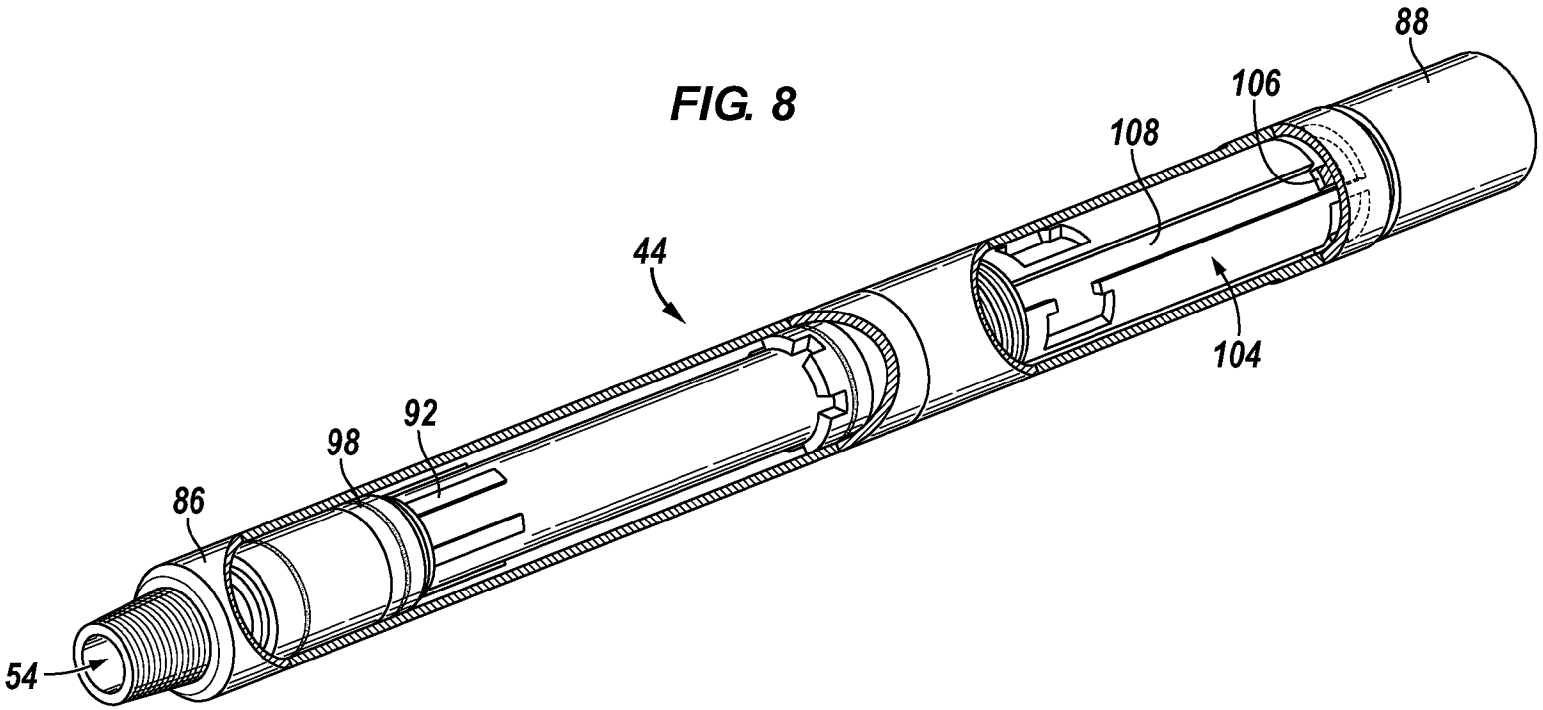
FIG. 8 is an illustration similar to that of FIG. 7 but showing the extension sub in another stage of operation, according to an embodiment of the disclosure.
Figure 9:
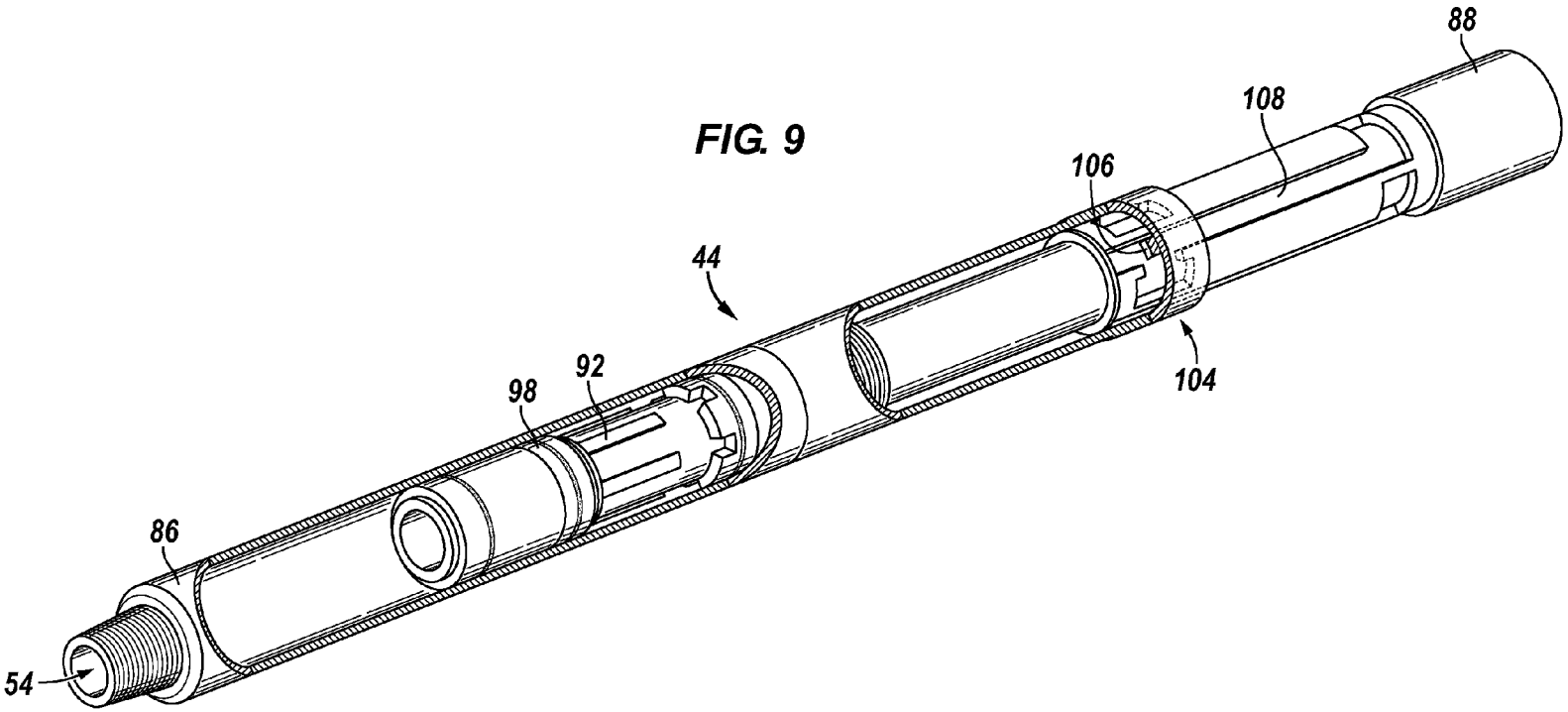
FIG. 9 is an illustration similar to that of FIG. 7 but showing the extension sub in another stage of operation, according to an embodiment of the disclosure.

To extend extension sub 44, fluid in internal passage 54 is sufficiently pressurized to cause release of torque collet 92, as illustrated in FIG. 8. Release of the torque collet 96 enables relative rotation between first component 86 and second component 88 by, for example, rotating the running string 38 uphole of the extension sub 44. The relative rotation is moved through a predetermined angle, e.g. 45° or other suitable angle, until members 106 are generally aligned with longitudinal sections of corresponding tracks 108, as further illustrated in FIG. 8. At this stage, a lifting force may be applied to the running string 38 to cause extension of extension sub 44 as members 106 move along the longitudinal sections of corresponding tracks 108, as illustrated in FIG. 9. The extension of extension sub 44 causes movement of window finder 42 in an uphole direction which, in turn, moves engagement feature 48 away from casing wall portion 50.

Figure 10:
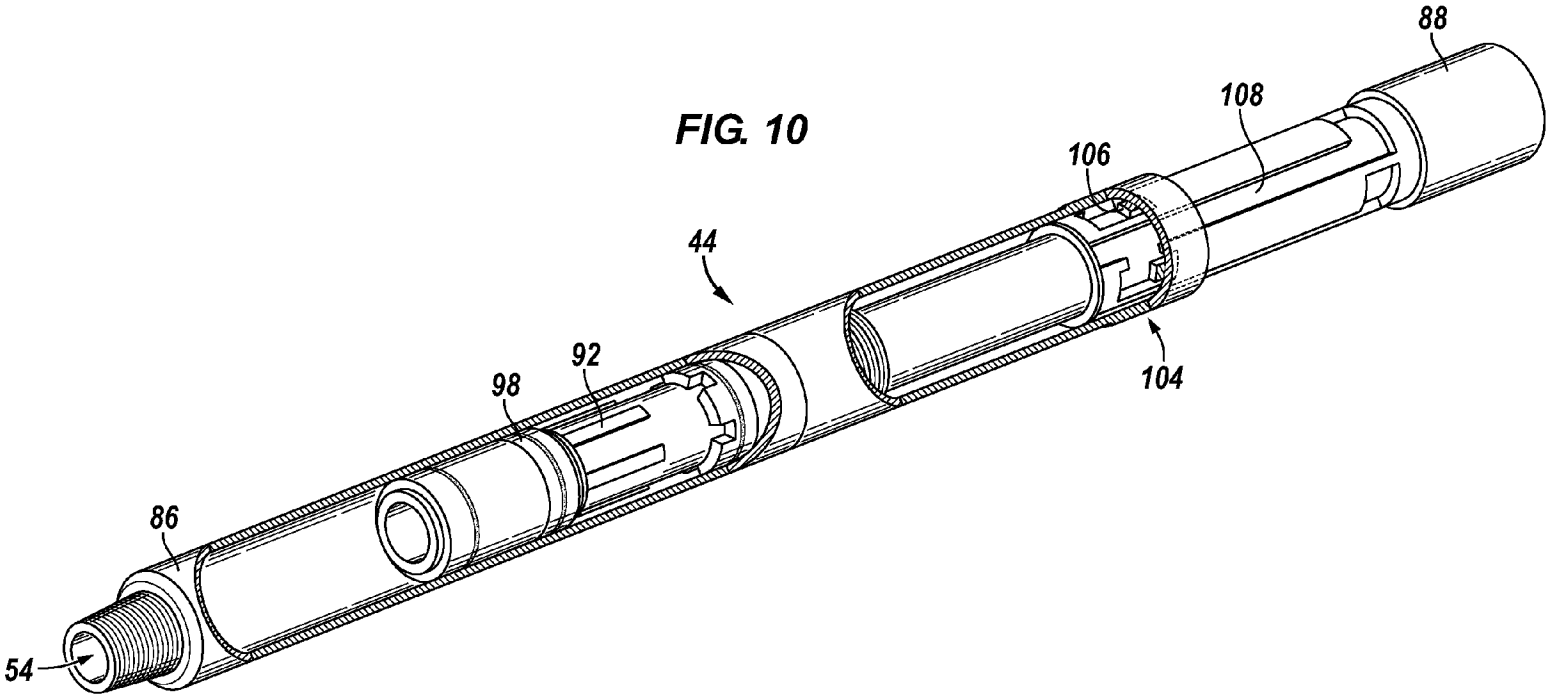
FIG. 10 is an illustration similar to that of FIG. 7 but showing the extension sub in an extended and locked stage of operation, according to an embodiment of the disclosure.

Once the extension sub 44 is transitioned to the extended configuration, relative rotation between first component 86 and second component 88 is again caused by, for example, rotating the running string 38 uphole of the extension sub 44. The relative rotation is moved through another predetermined angle, e.g. 45° or other suitable angle, until members 106 are positioned in a second set of generally circumferential sections of corresponding tracks 108, as illustrated in FIG. 10. When in the configuration illustrated in FIG. 10, the extension sub 44 is effectively locked in its extended position via locking mechanism 104. The extended, locked configuration enables application of a load force, e.g. set down force, in the direction of arrow 78 (see FIG. 5) to cause mechanical release of the running sub 40 from the surrounding lateral tube assembly 28 without interference between engagement feature 48 and casing wall portion 50.

Figure 11:
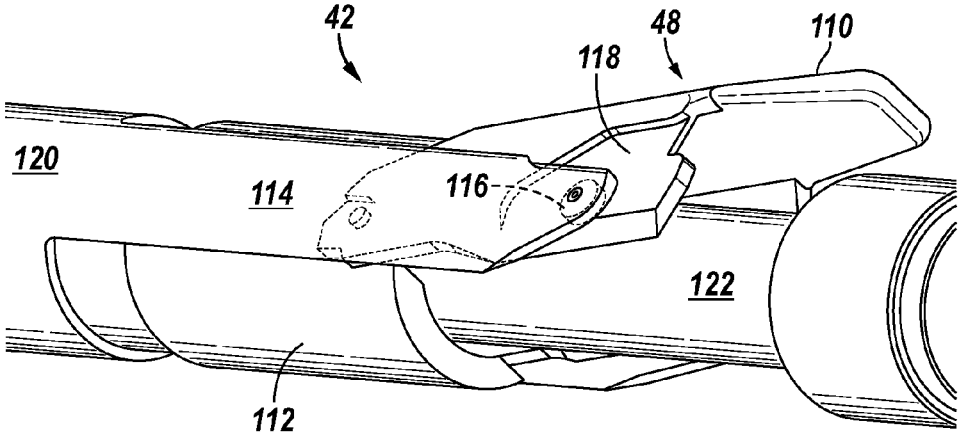
FIG. 11 is an illustration of an example of a window finder of the running string, according to an embodiment of the disclosure.

Referring generally to FIG. 11, an enlarged view of the window finder 42 is illustrated. In this embodiment, window finder 42 comprises engagement feature 48 in the form of a hook mechanism 110 pivotably mounted to a window finder block 112. The hook mechanism 110 is pivoted between a radially retracted position and a radially extended position (to engage casing wall portion 50) via at least one arm 114, e.g. a pair of arms 114. The arms 114 are coupled to hook mechanism 110 via a pin or pins 116 which travel along corresponding cam tracks 118. Linear movement of arms 114 in a desired direction moves the pins 116 along the corresponding cam tracks 118 to force the hook mechanism 110 to the selected radially retracted or extended position. In the embodiment illustrated, the at least one arm 114 is coupled with a window finder housing 120 which, in turn, is connected with window finder piston 52 (see FIG. 3). As described above, window finder piston 52 and spring 58 may be employed to move the housing 120 which moves the engagement feature 48, e.g. hook mechanism 110, between the radially extended and radially retracted positions, respectively. By way of example, spring 58 may be a compression helical spring.

Figure 12:
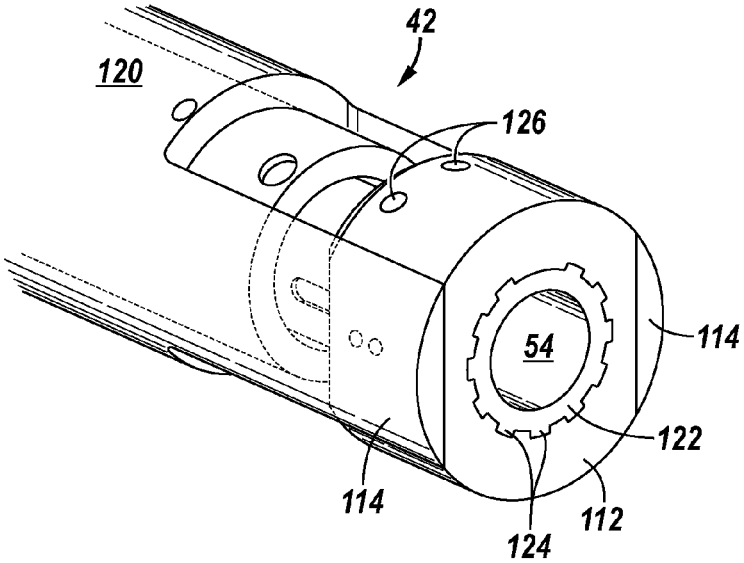
FIG. 12 is a cross-sectional view of the window finder illustrated in FIG. 11 taken transversely through the window finder and showing splines of the window finder which initially prevent rotation of a window finder block with respect to an internal mandrel, according to an embodiment of the disclosure.

With additional reference to FIG. 12, some embodiments of window finder 42 may secure block 112 to an internal mandrel 122. As best illustrated in the transverse cross-sectional view of FIG. 12, the block 112 may initially be secured to mandrel 122 by a plurality of splines 124 that prevent relative rotation between block 112/hook mechanism 110 and the mandrel 122 while engaged. The block 112 also may be secured to mandrel 122 by a shear member 126, such as a plurality of shear pins. In some applications, the number of shear pins may be selected according to the desired shear force used to release block 112/hook mechanism 110 with respect to mandrel 122. The torque generated by engagement feature 48/hook mechanism 110 as it slides along main casing window 34 is transmitted via splines 124 to orient the lateral tube assembly 28.

By applying a sufficient set down force against the window finder 42 while engagement feature 48/hook mechanism 110 is engaged with casing wall portion 50, the shear member 126 is sheared and the splines 124 may be shifted linearly and out of engagement. Once the splines 124 are disengaged, relative rotation of first component 86 and second component 88 of extension sub 44 can be performed without causing the hook mechanism 110 to incur interference with the casing edges forming main casing window 34. As described above, the extension sub 44 may be designed with sufficient linear compression spacing between first component 86 and second component 88 to enable the linear movement of mandrel 122 which shears the shear member 126 and disengages the splines 124. As best illustrated in FIG. 6, spring member 102 may be used to provide a bias against this linear compression of first component 86 and second component 88 prior to disengagement of block 112 from mandrel 122.

Various embodiments of lateral tube assembly 28 and running string 38 may be employed in many types of downhole applications and other applications in which separation of the running string 38 from the lateral tube assembly 28 is facilitated by a primary mechanical release and/or a redundant mechanical release. An example of a downhole application comprises initially moving lateral tubular structure 26 into lateral wellbore 30 via lateral tube assembly 28 and running string 38. The lateral tubular structure 26 is rotationally released via, for example, a releasable swivel to enable rotation of the lateral tube assembly 28 without rotating the lateral tubular structure/liner 26.

The window finder 42 is then employed to radially extend the engagement feature 48. The engagement feature 48 slides along the main casing window 34 and orients the lateral tube window 32 with respect to the main casing window 34. Once the engagement feature 48 engages casing wall portion 50 the lateral tube window 32 is properly oriented and aligned with respect to main casing window 34. After orienting and aligning the windows 32, 34, the lateral locating insert 36 may be set to engage the lateral tube assembly 28 with the main bore casing 22.

After the lateral tube assembly 28 is secured with respect to main bore casing 22, the running string 38 may be disconnected from lateral tube assembly 28. Initially, hydraulic release 60 may be actuated by applying pressurized fluid along the interior 54 of running string 38 in an effort to disengage the running sub 40 from the interior of lateral tube assembly 28. If, however, the hydraulic release is ineffective, the redundant mechanical release 76 may be actuated. Mechanical actuation comprises initially releasing the block 112 of window finder 42 from mandrel 122 by disengaging splines 124. It should be noted that in many applications the block 112 of window finder 42 may be released from mandrel 122 shortly after orienting and aligning lateral tube window 32 with main casing window 34. This early release of block 112 effectively simplifies any later mechanical release of the running string 38 from the lateral tube assembly 28.

Subsequently, the engagement feature 48 is disengaged from casing wall portion 50 by linearly extending extension sub 44. As described above, pressure is applied through internal passage 54 to release torque collet 92 and linear tension is applied. Upon rotational release, the relative rotation between first component 86 and second component 88 may be induced to enable linear extension of first component 86 and second component 88 as members 106 are moved along the longitudinal portion of corresponding tracks 108 of locking mechanism 104. When the extension sub 44 reaches the extended configuration, relative rotation between first component 86 and second component 88 is again performed until the extension sub 44 is locked in the extended position.

While extension sub 44 is in the extended, locked configuration, a set down weight, i.e. linear force 78, may be applied to the running string 38 to shear the shear member 82. Shearing of shear member 82 allows mandrel 80 to shift piston 66 of running sub 40. As described above, piston 66 is shifted until dogs 70 can retract into piston recesses 74, thus releasing the running sub 40 from the surrounding lateral tube assembly 28. At this stage, the running string 38 may be retrieved to the surface.

The lateral tube assembly 28 and the running string 38 may comprise many types of other and/or additional components depending on the specifics of a given application. The mechanical release 76 may be used alone, as a redundant release, or as a primary release with additional redundant release mechanisms. Furthermore, the mechanical release 76 may be used in combination with hydraulic releases or a variety of other types of releases. The various actuation members, shear members, shear pressures, actuating forces, and/or other actuating techniques may be used in a variety of combinations, levels, and sequences depending on the specifics of a given wellbore operation or other type of operation. The configuration of the various running string components, such as the window finder, extension sub, and running sub may be adjusted and components may be added and/or interchanged to accommodate various environments and parameters associated with a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for use with a lateral tube assembly, comprising:

deploying downhole into a wellbore a lateral tube assembly coupled with a running string having a running sub, a window finder, and an extension sub;

orienting a lateral tube window of the lateral tube assembly with a main window of a main bore casing by moving an engagement feature of the window finder into the main window and engaging a casing wall portion; and releasing the running string from the lateral tube assembly by: rotating the extension sub over a predetermined angle to enable extension of the extension sub, extending the extension sub to move the engagement feature away from the casing wall portion; rotating the extension sub to lock the extension sub in an extended position; and applying a set down force to the running string to release the running sub from the lateral tube assembly.

2. The method as recited in claim 1, wherein releasing comprises initially attempting to hydraulically release the running sub from the lateral tube assembly.

3. The method as recited in claim 1, wherein deploying comprises deploying the window finder with the engagement feature in the form of a hook mechanism.

4. The method as recited in claim 1, further comprising shearing a shear member in the window finder prior to extension of the extension sub by setting down weight on the window finder while the window finder is engaged with the casing wall portion.

5. The method as recited in claim 1, further comprising initially constraining the extension sub against rotation over the predetermined angle with a torque collet.

6. A system for disengaging components downhole, comprising:

a main bore casing having a main bore casing window;

a lateral tube assembly having a lateral tube window aligned with the main bore casing window; and a running string extending into the lateral tube assembly and coupled with the lateral tube assembly by a running sub, the running string further comprising a window finder having an engagement feature extending into the main bore casing window for engagement with a wall portion of the main bore casing, and an extension sub coupled to the window finder, the extension sub being selectively extensible to disengage the engagement feature from the wall portion and lockable in an extended position to enable application of sufficient force against the running sub to cause release of the running string from the lateral tube assembly, the extension sub comprising a first component slidably received by a second component, the first component and the second component initially held against relative rotation with respect to each other by a torque collet.

7. The system as recited in claim 6, wherein the running sub further comprises a hydraulic release designed to enable release of the running string from the lateral tube assembly.

8. The system as recited in claim 6, wherein the first component and the second component are slidably engaged via a cam received by a track.

9. The system as recited in claim 6, wherein relative rotation of the first component with respect to the second component in the extended position enables the extension sub to lock in the extended position.

10. The system as recited in claim 6, wherein the engagement feature is in the form of a hook.

11. The system as recited in claim 6, wherein the engagement feature is initially held against rotation with respect to an internal mandrel by a shear member and splines.

12. A system for disengaging components downhole, comprising:

a main bore casing having a main bore casing window;

a lateral tube assembly having a lateral tube window aligned with the main bore casing window; and a running string extending into the lateral tube assembly and coupled with the lateral tube assembly by a running sub, the running string further comprising a window finder having an engagement feature extending into the main bore casing window for engagement with a wall portion of the main bore casing, and an extension sub coupled to the window finder, the extension sub being selectively extensible to disengage the engagement feature from the wall portion and lockable in an extended position to enable application of sufficient force against the running sub to cause release of the running string from the lateral tube assembly, the extension sub comprising a first component slidably received by a second component, wherein relative rotation of the first component with respect to the second component in the extended position enables the extension sub to lock in the extended position.

13. The system as recited in claim 12, wherein the running sub further comprises a hydraulic release designed to enable release of the running string from the lateral tube assembly.

14. The system as recited in claim 12, wherein the first component and the second component are slidably engaged via a cam received by a track.

15. The system as recited in claim 12, wherein the engagement feature is in the form of a hook.

16. The system as recited in claim 12, wherein the engagement feature is initially held against rotation with respect to an internal mandrel by a shear member and splines.

17. A system for disengaging components downhole, comprising:

a main bore casing having a main bore casing window;

a lateral tube assembly having a lateral tube window aligned with the main bore casing window; and a running string extending into the lateral tube assembly and coupled with the lateral tube assembly by a running sub, the running string further comprising a window finder having an engagement feature extending into the main bore casing window for engagement with a wall portion of the main bore casing, and an extension sub coupled to the window finder, the extension sub being selectively extensible to disengage the engagement feature from the wall portion and lockable in an extended position to enable application of sufficient force against the running sub to cause release of the running string from the lateral tube assembly, wherein the engagement feature is initially held against rotation with respect to an internal mandrel by a shear member and splines.

18. The system as recited in claim 17, wherein the running sub further comprises a hydraulic release designed to enable release of the running string from the lateral tube assembly.

19. The system as recited in claim 17, wherein the extension sub comprises a first component slidably received by a second component.

20. The system as recited in claim 19, wherein the first component and the second component are slidably engaged via a cam received by a track.

21. The system as recited in claim 17, wherein the engagement feature is in the form of a hook.

* * * * *